United States Patent [19]

Hasak

[11] Patent Number: 4,658,867

[45] Date of Patent: Apr. 21, 1987

[54] PROCESS AND EQUIPMENT FOR THE PRODUCTION OF REINFORCEMENT BASKETS FOR LARGE-BORE PILES

[75] Inventor: Wilhelm Hasak, Pfettrach, Fed. Rep. of Germany

[73] Assignee: Landshuter Baueisenbiegerei GmbH, Altdorf, Fed. Rep. of Germany

[21] Appl. No.: 718,138

[22] Filed: Apr. 1, 1985

[30] Foreign Application Priority Data

Jun. 14, 1984 [DE] Fed. Rep. of Germany ..... 3422099

[51] Int. Cl.[4] ..... B21F 15/08

[52] U.S. Cl. ..... 140/112; 140/92.2; 269/296

[58] Field of Search ..... 140/92.1, 112, 92.2, 140/107; 29/163.5 CW; 269/60, 153, 287, 296

[56] References Cited

U.S. PATENT DOCUMENTS

| | | | |
|---|---|---|---|
| 2,463,383 | 3/1949 | Hokanson | 269/296 |
| 3,209,793 | 10/1965 | Miura | 140/112 |
| 3,592,243 | 7/1971 | Fukushima | 140/112 |
| 3,661,186 | 5/1972 | Nordgren | 140/112 |
| 3,789,894 | 2/1974 | Adams | 269/296 |
| 4,377,928 | 3/1983 | Hasak | 52/653 |
| 4,467,583 | 8/1984 | Hasak | 52/653 |

FOREIGN PATENT DOCUMENTS

| | | | |
|---|---|---|---|
| 3000605 | 9/1981 | Fed. Rep. of Germany . | |
| 3221671 | 12/1983 | Fed. Rep. of Germany . | |
| 45-31380 | 10/1970 | Japan | 140/112 |
| 894798 | 4/1962 | United Kingdom . | |
| 797829 | 1/1981 | U.S.S.R. . | |

*Primary Examiner*—Frederick R. Schmidt
*Assistant Examiner*—Robert Showalter
*Attorney, Agent, or Firm*—Karl F. Ross; Herbert Dubno

[57] ABSTRACT

Method of and apparatus for making reinforcement baskets for large diameter piles in which a pair of reinforcement hoops formed with spaced apart eyes are held in respective clamping fixtures on a pair of carriages displaceable on rails and the primary bars are pressed through these eyes while auxiliary bars are welded to the hoops between the primary bars. A helical wire is wound around the bars as the clamps are rotated and is welded to the bars while a support, also on a carriage displaceable along the rails, cradles the basket from below.

8 Claims, 7 Drawing Figures

PROCESS AND EQUIPMENT FOR THE PRODUCTION OF REINFORCEMENT BASKETS FOR LARGE-BORE PILES

FIELD OF THE INVENTION

The invention relates to a process and equipment for the production of reinforcement baskets.

BACKGROUND OF THE INVENTION

In a presently known process for making reinforcement basket (German Pat. No. 30 00 605) there is no possibility to automate production of such reinforcement baskets, because of their large diameter and their length. Manual production is however time consuming and costly.

There are processes known for the automatic production of reinforcement baskets (for instance German open application 3 221 671, British Pat. No. 894 798 or USSR Inventor's Certificate 797 829), but these processes are only suitable for the production of reinforcement baskets of limited length and limited diameter, since in these cases the longitudinal bars are supplied by guide ducts and are maintained in position by means of holding wires, without reinforcement hoops. Thereby, the length of the basket is limited by the length of the guiding duct. If a change in the diameter of the basket is desired, time-consuming readjustment operations of the machine are required.

OBJECT OF THE INVENTION

It is therefore the object of this invention to develop a method which makes possible a definite, automatic production of the reinforcement baskets.

This object is attained through the solution defined in claim 1.

Due to the invention, it becomes possible to produce large and long reinforcement baskets for bored piles, whereby length and diameter are largely variable.

An equipment to carry out the method is defined in claim 2.

Since the installaton according to the invention is not constructed as a unit, but made of modules, it is easy to transport and to mount, so that it is possible to produce large and long reinforcement baskets on the spot where they are used, so that transportion costs can be saved.

Advantageous developments of the invention result from the dependent claims.

Due to the fact that the feed ratchet on the tension carriage is height adjustable, the diameter of the reinforcement baskets to be produced can be largely modified, whereby a safe support of the reinforcement basket by the support carriage is always insured. By modifying the distance between the tension carriages, it is possible to adjust in a simple manner the desired length of the reinforcement basket.

The support carriages are movable along the guiding rails in an advantageous manner so that they support the reinforcement basket in the area where support is required.

Due to the support surfaces angularly connected to each other, which are provided on the support carriage a good adjustment to the profile of the reinforcement baskets is achieved, whereby the rollers or belts provided on the support surfaces faciltates the rotation of the reinforcement baskets.

Due to the fact that angle formed by the positon of the individual support surfaces with respect to each other can be modified by means of joints provided between the individual support surfaces, it is possible to adjust the support surfaces to the various diameters of the reinforcement baskets.

The various diameters of the reinforcement baskets can be adjusted in a simple manner by means of clamping jaws which are slidable in guide grooves, located in the individual crosspieces, from the central point of the ratchet towards its circumference.

Further it is advantageous to provided between the support carriages a drivable gear meshing with the bars. This gear prevents the twisting of the bars in the case of particularly long reinforcement baskets.

BRIEF DESCRIPTION OF THE DRAWING

An embodiment of the invention is represented in the drawing and is described in detail in the following description. In the drawing.

SPECIFIC DESCRIPTION

Figure 1:
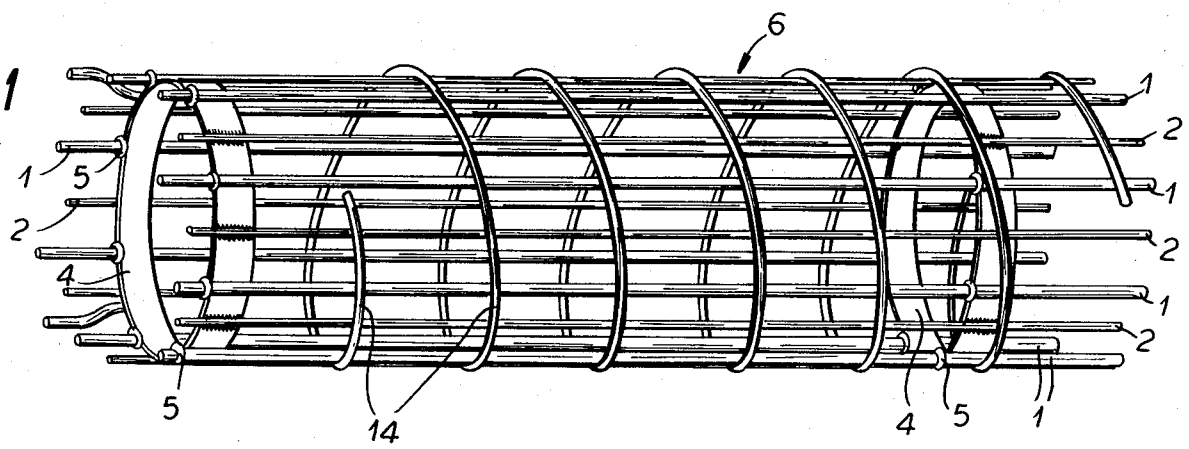
FIG. 1 is a view in perspective of the reinforcement basket produced in accordance with the method.
Figure 6:
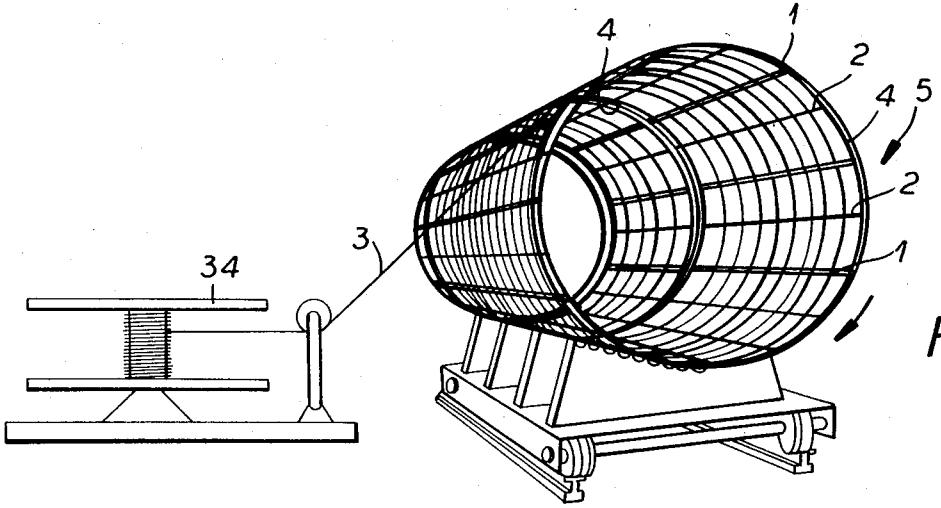
FIG. 6 is a view in perspective of a reinforcement basket arranged on several support carriages.

For the production of a reinforcement basket 6 for large-bore piles, as shown in FIG. 1, reinforcement hoops 4 are mounted in the longitudinal direction of the reinforcement basket to be produced and are connected at the circumference with longitudinal bars at equal distances. In this way the rigidity of the basic structure of the reinforcement basket 6 is insured. Further, between the longitudinal bars 1, auxiliary bars 2 are welded to the hoops, the auxiliary bars serving for the fastening of a screw thread 14 of a holding wire 3 applied to the bars 1, 2 and for the augmentation of the rigidity of the reinforcement basket 6. In order to fasten the longitudinal bars 1 the reinforcement hoops 4 are inserted in two opposite rotatable tensioning devices 15, which are mounted on the tension carriage 12 slidabong the guiding rails 16. At their circumference, the reinforcement hoops 4 have arresting means 5, wherein the longitudinal bars 1 are being fitted, the bars being then connected with the reinforcement hoops 4 through their engagment with the arresting means 5.

After that, the tensioning devices 15 with the reinforcement hoops 4 and the thereto affixed longitudinal bars 1 are rotated, so that they come to rest on the support carriage 13 provided between the tension carriages 12. This way a new free area of the reinforcement ring 4 reaches the working area of the operating personnel, whereby repeatedly the longitudinal bars 1 can be brought in contact with the reinforcement hoops 4. This process is continued, until the entire circumference of the reinforcement hoop is provided with longitudinal bars 1, respectively auxiliary bars 2. After that, a screw thread 14 made of the holding wire 3 is wound in a known manner on the bars 1, 2 through the rotation of the basic structure via the tensioning device 15 and connected with the bars 1, 2 through welding or through racking.

The equipment to carry out this method is represented in FIGS. 1 to 7.

Figure 2:
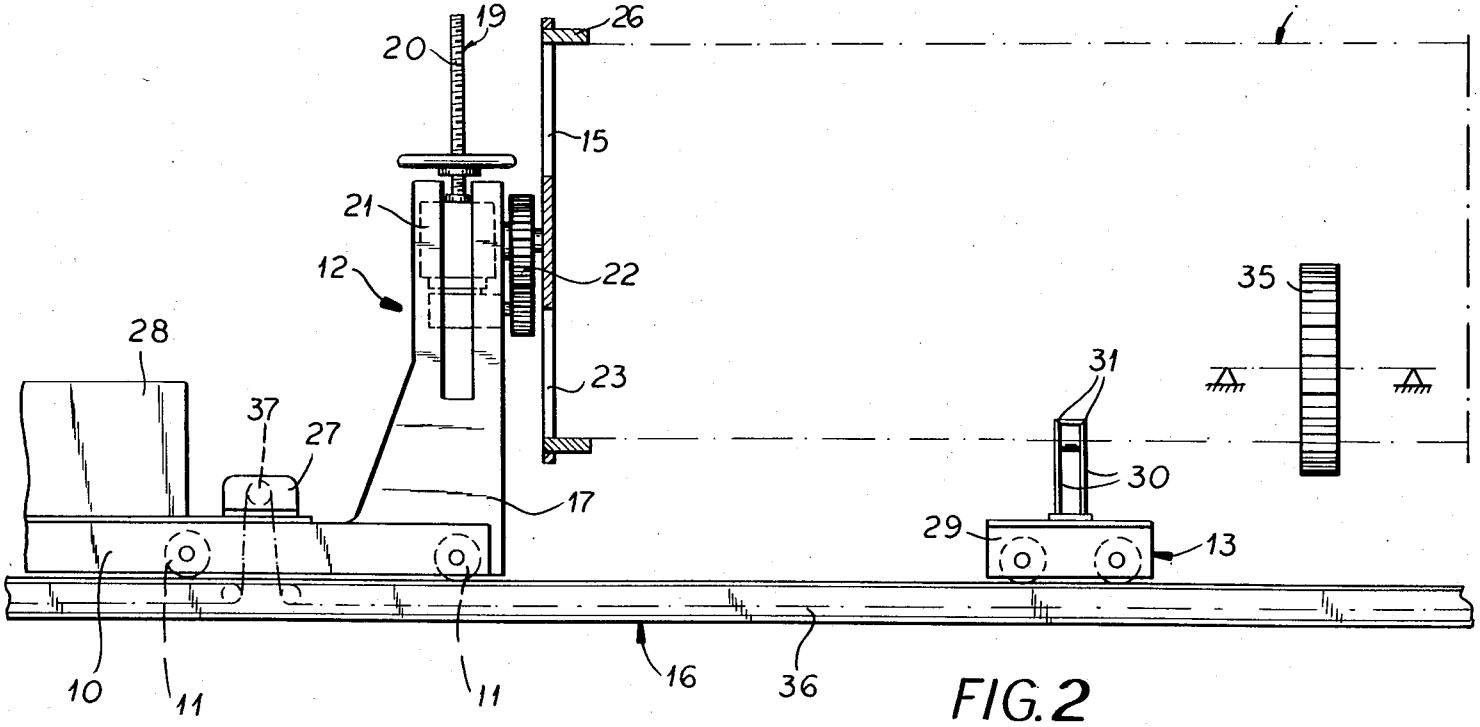
FIG. 2 is a schematic side view of the terminal part of the installation with tension carriage and support carriage.
Figure 3:
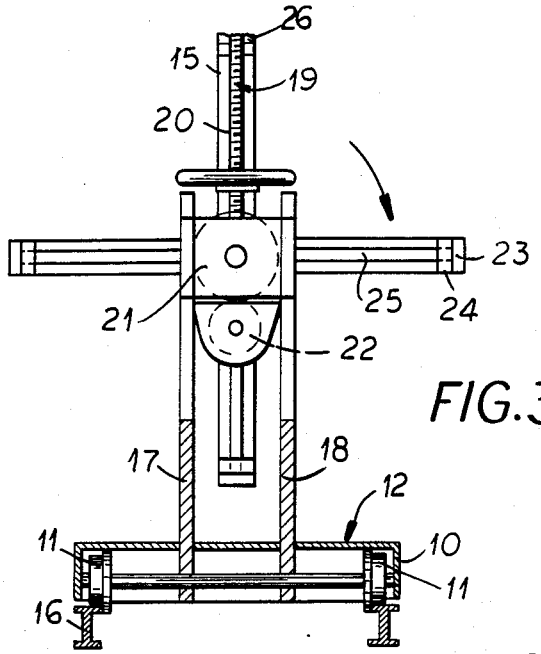
FIG. 3 is a schematic top view of the tension ratchet of the tension carriage.

In FIG. 2 only a terminal part of the installation is shown, the opposite part thereof being identical.

Between the two end areas run the guide rails 16, on which the support carriages 13 are arranged. In the end area, a tension carriage 12 is provided on the guide rails 16. The tension carriage 12 has a base frame 10 with four wheels 11. The tension carriage 12 is movable due to a chain 36 provided in the guide rail 16 and which sets in motion a drivable sprocket 37 mounted on the tension carriage 12. On the base frame 10 there is a construction, made of two plates 17, 18, spaced apart and parallel to each other, running transversally to the direction of the guide rails 16, the height-adjustable tensioning device being located therebetween.

The tensioning device 15 comprises comprises a device for height adjustment 19, for instance in the shape of a spindle 20 with a guide sleeve 21 movable along the spindle 20 and a rotating device 22 with a ratchet 23 (see FIG. 40, mounted on the device for height adjustment 19. The device for height adjustment 19 and the rotating device 22 can be actuated electrically as well as hydraulically.

In the ratchet 23 (see FIG. 3) on each cross piece 24 guide grooves 25 are provided, wherein longitudinally movable clamping jaws are arranged.

Behind the structure made of plates, on the base frame 10 a traction motor 27 for driving the wheels 11 and in given cases a hydraulic assembly for the oil engines for the height adjustment are provided to assist the turning of the rotation device 22.

Figure 5:
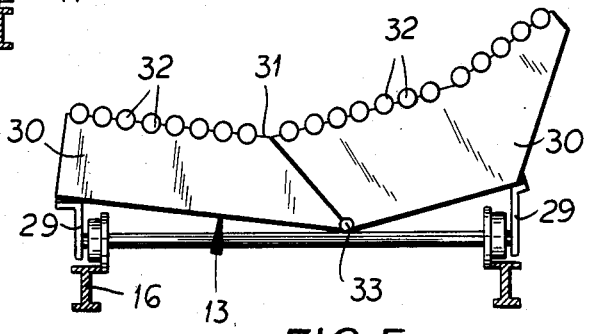
FIG. 5 is a schematic side view of the support carriage.
Figure 4:
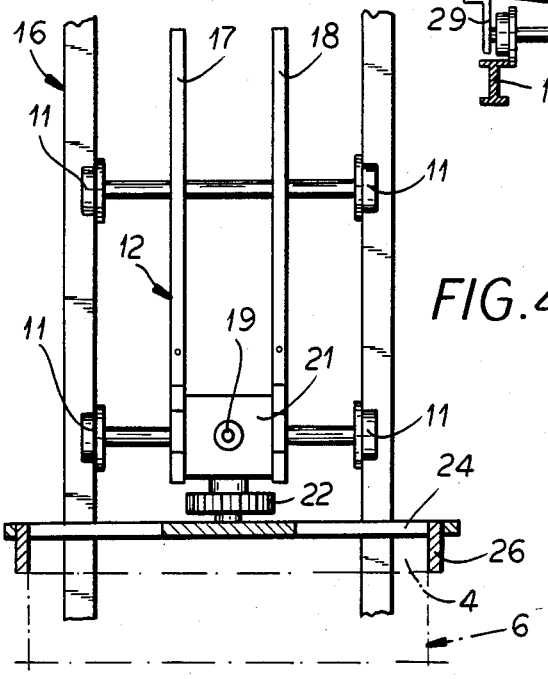
FIG. 4 is a schematic top view of the tension carriage.

Depending on the desired length of the reinforcement basket 6 to be produced, a number of support carriages 13 are arranged at a distance from each other. A support carriage 13 comprises a base frame 29, with two parallel segment plates 30, set at a distance from each other in the direction of the guide rails. The segment plates 30 are constructed with their upper edges 31 capable to form a guide with rollers 32, as shown in FIG. 5. Instead of the rollers 32, belts (which are not shown) can be provided, serving also for the creation of a guide surface. The rollers 32 or the belts can be driven, in order to assist the rotation of the ratchet 23.

Figure 7:
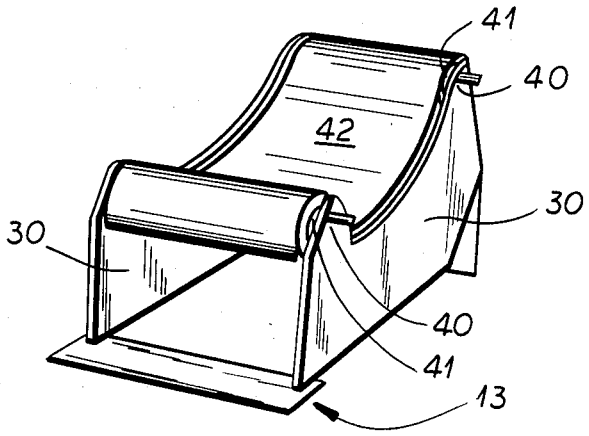
FIG. 7 is another embodiment of a support carriage.

For another alternate type of guide, such as the one shon in FIG. 7, two rollers 41 are pivoted on the upper lateral areas 40 of the segment plates 30. On these rollers an endless conveyor belt 32 made of rubber material, in certain cases reinforced rubber- is loosely supported. The conveyor belt is approximately as wide as the support carriage 13 (approx. 0.5 m) and can be entrained to run accordingly to the turning motions of the ratchet 23. Actuating means for the conveyor belt to assist the turning motions of the ratchet can be provided. This type of guidance ensures a particularly smooth rotation of the basket.

The segment plates 30 can be staggered with respect to each other with the aid of a suitable joint 33, so that the shape of the guiding surface can be adapted to the diameter of the reinforcement basket 6. A coil 34 with the holding wire 3 is mounted laterally in front of the guide rail 16, approximately in the middle of the basket to be produced. In order to apply the holding wire 3 the basket is turned in the direction of the arrow by the rotating device 22 and the coil 34 is moved in both directions alongside the basket. It is also possible to start the winding at one end of the basket.

In the case of particularly long baskets, a rotatable gear 35 can be provided between both carriages 12, or between two support carriages 13 in order to assist the turning of the basket and to avoid a twisting of the basket.

The helix 14 made of the holding wire 3 is then connected in the usual manner with the longitudinal and auxiliary bars 1, 2 via welding or tacking.

It is self-understood that the installation can be also be constructed to be manually operatable.

Since the installation consists of modules it is easily transportable, so that the expensive and cumbersome transportation of large reinforcement baskets can be eliminated.

I claim:

1. A method of making a reinforcement basket for a large-bore pile which comprises the steps of:

supporting each of a pair of reinforcement hoops adapted to form part of the basket so that said hoops lie in vertical planes and are spaced apart from one another along a pair of rails by gripping each of said hoops in a respective rotatable clamping device which engages an outer periphery of the hoop on a respective clamping carriage adapted to travel along said rails, said hoops each being provided with a plurality of spaced apart eyes;

placing a multiplicity of reinforcing rods on a support located between said hoops;

while rotating said devices about a common substantially horizontal axis, individually inserting said reinforcing bars carried on said support through said eyes to form a cage with substantially parallel reinforcing bars held in place by said hoops and adapted to be rested on said support which is displaceable on said rails; and rotating said devices and thereby rotating said cage while said cage is supported by said support and coiling a wire helically around said cage during the rotation thereof and welding said wire to said bars, thereby forming the reinforcement basket with said hoops incorporated thereon.

2. An apparatus for making a reinforcement basket for large-bore piles which comprises:

a pair of parallel rails;

respective clamping carriages guided by and displaceable on said rails and spaced apart from one another;

respective clamping devices rotatably mounted on said carriages and engageable with outer peripheries of respective reinforcement hoops adapted to be incorporated in the basket to support said hoops in respective vertical planes for rotation about a common substantially horizontal axis whereby a reinforcement basket can be formed from said hoops, each of said hoops being provided with a plurality of spaced apart eyes;

at least one upwardly concave support disposed beneath said basket and cradling same between said clamping carriages and mounted on upon a support carriage displaceable on said rails;

means on at least one of said carriages for rotating said clamping devices about said axis while said bars rest upon said support to enable the insertion of reinforcement bars on said support into said eyes to form said basket and for thereafter rotating said basket with said hoops incorporated therein, said supports having surfaces entrained by contact with said basket upon rotation thereof; and means between said carriages for winding a helical wire onto said basket as it is rotated by said devices, whereby said wire is welded to said bars, each of said clamping devices comprise being at least three arms engaging the respective hoop, said arms being formed with guide grooves in which respective clamping jaws are radially movable.

3. The apparatus defined in claim 2 further comprising means on each of said clamping carriages for adjusting the height of the respective clamping device.

4. The apparatus defined in claim 3 wherein each of said clamping carriages is driven by means of a chain mounted in said guide rails and looped over a drivable sprocket rotatable on the respective clamping carriage.

5. The apparatus defined in claim 3 wherein said support carriage is provided with segment plates hinged together and provided with movable elements engageable with said basket.

6. The apparatus defined in claim 5 wherein said movable elements are rollers.

7. The apparatus defined in claim 5 wherein said movable elements are belts.

8. The apparatus defined in claim 5 wherein a plurality of supports and respective support carriages are provided along said rails and a gear is disposed between said support carriages to mesh with the bars of said basket.

* * * * *